8-109 SR
FIP8309 XR 4,106,979

United States Patent [19]
Ruffini et al.

[11] 4,106,979
[45] Aug. 15, 1978

[54] PREPARATION OF PAPER PULPS FROM DICOTYLEDONOUS PLANTS

[75] Inventors: Guglielmo Ruffini, Lovere; Erio Pezzotti, Cassano Magnago, both of Italy

[73] Assignee: Consorzio Fabocart S.p.A., Milan, Italy

[21] Appl. No.: 779,293

[22] Filed: Mar. 21, 1977

[51] Int. Cl.[2] ..... D21C 3/02; D21C 3/20; D21C 9/16

[52] U.S. Cl. ..... 162/73; 8/109; 8/110; 8/111; 162/76; 162/78; 162/85; 162/86; 162/89; 162/90; 162/93; 162/98

[58] Field of Search ..... 162/23, 24, 26, 55, 162/71, 72, 73, 76, 78, 83, 84, 85, 86, 88, 89, 90, 93, 98, 99, 20; 241/21, 24, 28; 8/108 R, 108 A, 109, 110, 111

[56] References Cited

U.S. PATENT DOCUMENTS

| | | | |
|---|---|---|---|
| 2,639,988 | 5/1953 | Zeehvisen | 162/20 |
| 2,738,271 | 3/1956 | Fabian | 162/98 X |
| 2,913,362 | 11/1959 | Cusi | 162/55 |
| 3,224,925 | 12/1965 | Brandts et al. | 162/93 |
| 3,388,037 | 6/1968 | Asplund et al. | 162/26 X |
| 3,620,910 | 11/1971 | Lawrence | 162/93 X |

FOREIGN PATENT DOCUMENTS

| | | | |
|---|---|---|---|
| 414,801 | 3/1966 | Japan | 162/98 |

OTHER PUBLICATIONS

A.B.I.P.C., vol. 45, 7–12, 1974, #3799.
A.B.I.P.C., vol. 46, 7–12, 1975, #4825.
Clark et al., "A Search for New Fiber Groups V Pulping Studies on Kenaf", TAPPI, vol. 45, No. 10, 10–1962, pp. 780–786, 162–198.

*Primary Examiner*—Arthur L. Corbin

[57] ABSTRACT

Paper pulp is prepared from dicotyledonous plants by stirring said plants in an alkaline solution in the presence of a surfactant and stain inhibiting agent to obtain a stock containing a woody core fraction and a bark fraction containing bast fibers, separating said fractions and then cooking and bleaching the bark fraction in an alkaline solution containing an oxidizing agent and an alkyl sulfate surfactant.

7 Claims, No Drawings

PREPARATION OF PAPER PULPS FROM DICOTYLEDONOUS PLANTS

This invention relates to a process for the production of pulps for paper from non-wood plants, specifically for dicotyledoreous plants, and more particularly to a process for efficiently producing mechanical, chemimechanical or semichemical and chemical pulps from the same cellulosic fibrous material.

A dicotyledonous plant has two morphologically distintive regions in its stem, the outer or bark fraction which contains the bast fibers and the inner or woody core. The ratio between the stalk components of a dicotyledonous plant varies according to the different species, the nature of soil, the population density of the plantation and growing conditions. The outer portion comprises 40–25% while the woody core comprises 60–75% of the whole stalk. Furthermore, the bark and woody core fibers greatly differ as far as the chemical composition and their morphological structure are concerned.

The preferred non-wood cellulosic raw material to be treated with the process of the present invention is Kenaf, Hibiscus Cannabinus or other members of the Hibiscus family.

Other dicotylendonous plants which may be used in the practice of this invention are Jute, Sunn hemp (Crotalaria), common hemp (*Cannabis Sativa*) etc. The whole stem used in the practice of this invention may be either green or aged and desiccated.

Kenaf originates from India or Tropical Africa and now is cultivated all over the world. It is a kind of annual plant which grows in height from 8 to 12 feet or more in 4–6 months. Kenaf has been used for various purposes from ancient times. Its bast fibers are used in manufacturing rope, coarse cloth, net bags, etc.

More recently extensive research has been carried out on this raw material as a source of pulp for papermaking because of its high yield per hectare (10–20 ton. of dry matter).

All this research has demonstrated the high potential of kenaf as a source of paper pulp.

Kenaf stalks have been used without decortication, e.g., as whole stalk, for producing refiner mechanical pulps (U.S. Pat. No. 3,620,910) and chemical pulps (Clark T.F. et al. Tappi 45–(10)–780).

The refiner mechanical pulp obtained was of good quality and the chemical pulps have strength characteristics between hardwood and chemical pulps.

The kenaf chemical pulp of the whole stalk has very low drainage characteristics and abnormally low air permeability. The short fibers of the woody core, when chemically cooked, are responsible for these disadvantages that render the pulp extremely difficult to wash. Even if a relatively small proportion of such a pulp is used in making paper, it becomes necessary to slow down the paper machine speed appreciably. Cooking of the two separated fractions has been carried out showing the possibility of obtaining from the bast fibers a pulp having characteristics similar to those of a softwood chemical pulp, while the pulp from the woody core is unsuitable for papermaking purposes. However, the high cost of producing the bast fibers alone has rendered it uneconomical for pulp and paper production.

It appears that for this raw material to be acceptable as an economic papermaking fiber, it will be necessary to first separate the two components, which are greatly different in physical, chemical and morphological characteristics, before treating either component.

Then each component has to be treated separately under appropriate conditions in order to obtain pulps with specifically suitable characteristics.

It is a main object of this invention to provide a method for an economical separation of the two components of dicotyledonous plants.

It is a further object of this invention to provide a method for pulping in non pressurized equipment and bleaching the long fiber component.

It is another object of this invention to provide such a method which utilizes equipment presently in use in the commercial pulping process.

According to the present invention, there is provided a process for the production of pulps for paper from dicotyledonous plants comprising the steps of chopping the lignocellulosic material, defibrating said cellulosic material in a pulper by mechanical and chemical action with steam treatment to allow separation of the woody core from the bark fibers, dividing said stock into a long fiber bark fraction and woody fraction, said woody fraction being utilized for refiner groundwood of chemimechanical or semichemical pulp production and said long fiber fraction being utilized as stock for the production of bleached pulp.

The step of chopping and dry cleaning of annual plants is in common practice. The treatment in a hydropulper of chopped kenaf made into an aqueous slurry in order to remove soluble materials and fines such as epidermis and parenchyma cells has been already fully described (TAPPI non wood plant Fiber pulping Progress report N.3 pp.5–24, 1972).

Such a treatment comprises pulping the chopped kenaf at about 5–5.5% consistency in water in a hydropulper equipped with a perforated bottom for ten minutes at room temperature and discharging the water. The fibers remaining in the hydropulper after a second screening are then ready for pulp preparation. The yield of this treatment is around 83%.

This procedure is similar to that which is commonly used for the wet depithing of bagasse.

The pulping or defibration step utilized in this invention comprises the treatment of chopped kenaf or other dicotyledonous plants in a high shear action pulper with steam and chemical products for 30–60 minutes, at a temperature varying from 50° to 90° C, and preferably at 75°–80° C. The combined mechanical, chemical and heating actions provide the separation of woody core from bast fibers. The woody core is maintained in large pieces in order to be successively separated from the bast fibers which are reduced to single fibers without significant deterioration of fiber strength. The novelty of this step in comparison to the known wet cleaning procedure of annual plants resides in the use of heat and chemical products. Heat and chemicals soften the lignin of bast fibers preventing a reduction of fiber strength during the defibration step and subsequent treatments.

The chemicals used in this pulping step are alkaline materials such as caustic soda, sodium carbonate, sodium sulfite and the like, a wetting agent selected from the group consisting of non ionic, cationic and anionic surface active wetting agents and chemical products that prevent the staining of the fibers in alkaline media by blocking the chromophoric groups of the raw material. Such chemical products may be sodium and hydrogen peroxide, sodium hypochlorite or organic peroxide.

After the defibration step the raw material is separated into two fractions by means of suitable screens such as centrifugal screens or vibrating screens.

The separated bast fibers, refined in order to shorten their length, centrifugally cleaned to remove residual sand and dark specks from the thin layer of the bark and thickened, are utilized as stock for production of bleached pulp, according to a method that is one of the objects of the present invention.

This method is based on some interesting properties of the bast fibers portion of dicotyledonous plants, especially their fast rate of impregnation by chemical agents, low lignin content and easily bleachability.

In conventional cooking of bast fibers the chemical reactions are carried out under rather drastic conditions of temperature, pressure and time to remove most of the lignin. The residual lignin left in the fibers is in condensed form, difficult to be bleached (at least three stages of bleaching are necessary to achieve a brightness of 78–80 Elrepho). Furthermore, in full chemical pulping the removal of most of the lignin results in a yield of unbleached pulp in the range of 40–45% of the original fibers.

In the present process, the novel and surprising feature resides in the observation that the exposure of bast fibers to alkali in the presence of relatively small quantities of an oxidizing agent such as sodium or hydrogen peroxide, organic peroxide or sodium perborate results in a bleached pulp (80–82 brightness) with yields up to 95% of the original separated bast fibers fraction. Most of the original lignin is left incorporated in the fibers; however the pulp obtained by the novel process has to be considered as a chemical pulp as far as the brightness and physical strength is concerned. An additional advantage of this process is that the spent cooking liquor can be used in the defibration step.

The novel cooking process described above has been accomplished by treating an aqueous slurry of the separated bast fibers with 2–6% hydrogen peroxide, 5–20% alkali, 0.1–0.5% of wetting agent (based on the weight of dry matter) at 50°–90° C for 30–120 minutes. Magnesium salts and sequestering agents may be also used.

After the completion of this step the pulp is thoroughly washed and acidified to pH 5–6 with an aqueous solution of sulfur dioxide or oxalic acid. The pulp obtained has a brightness of 78–82 Elrepho depending on the brightness of the starting raw material.

In order to achieve higher brightness (85 or over) a lignin modifying pretreatment before the atmospheric pressure cooking is necessary. The preferred chemicals used in such a pretreatment are chlorine dioxide or sodium chlorite; chlorine and sodium hypochlorite may also be used.

The pretreatment is carried out with 2–10% active chlorine at a temperature varying from room temperature to 80° C for 30 to 120 minutes. After the pretreatment the bast fibers are washed, thickened and simultaneously cooked and bleached in one step following the procedure described above.

The separated woody core fraction can be used as stock for the preparation of refiner groundwood, chemimechanical or semichemical pulp following procedures known in the art.

For a better understanding of the objects and advantages of the present invention, the same will be now described by means of several examples. However, it should be understood that the invention is not limited to such specific examples, but other alterations may be contemplated within the scope and without departing from the spirit of the invention as set forth in the appended claims.

EXAMPLE 1

500 g. (b.d.) of kenaf whole stalks (Everglade 71) field dried and stored for two years was forage chopped to about 0.5 inch in length. The chopped material was stirred in a pulper for 45 minutes in hot water (75° C) containing 3.5% caustic and 1.5% sodium sulfite based upon the weight of the dry kenaf. The pulped material was then discharged and the bast fibers were separated from the woody core fraction by screening on a laboratory Weverk fractionator using a 0.30 mm. slit screen. The total yield was 82%.

The woody core fraction was reduced to pulp with a yield of 51.2% by grinding in a 12 inches Sprout Waldron disc refiner.

The bast fibers separated in the classification were mildly refined, thickened and treated at 85° C at 15% consistency for 60 minutes with a solution containing 4.4% sodium hydroxide 3.8% sodium carbonate (as NaOH), 1.7% hydrogen peroxide, 12.5% sodium perborate and 0.2% alkyl sulfate, based upon the weight of the dry fibers. At the end of this treatment the pulp was thoroughly washed and acidified with an aqueous solution of sulfur dioxide to a pH of 5.5–6. The final yield was 29.4% of the initial whole kenaf stalk. The total alkali consumption was 4.5% while the hydrogen peroxide consumption (including the sodium perborate) was 3.5% based upon the weight of bleached bone dry pulp. The physical characteristics of both pulps are given in Tables 1 and 2.

EXAMPLE 2

500 g. (b.d.) of kenaf whole stalk (Hibiscus Sabdariffa) were separated into a woody core fraction and a bark fraction following the technique described in example 1.

A chemimechanical pulp was prepared from the woody core fraction by grinding it in a Sprout Waldron disc refiner and treating the pulp at 15% consistency with a solution containing 8% sodium hydroxide, 3% hydrogen peroxide and 3% sodium silicate at 70° C for 120 minutes.

At the end of this treatment the pulp was thoroughly washed and acidified to pH of 5.5–6 with an aqueous solution of oxalic acid. The pulp characteristics are given in Table 1.

The bark fraction, after a mild refining in a disc refiner, was treated at room temperature with an aqueous solution containing 10% active chlorine (based on the weight of bone dry fibers) for 30 minutes. The pulp was then washed and thickened and treated at 15% consistency with a solution containing 4.4% sodium hydroxide, 3.8% sodium carbonate (as NaOH), 1.7% hydrogen peroxide, 12.5% sodium perborate and 0.2% alkyl sulfate detergent (based on the weight of b.d. fibers) for 120 minutes at 70° C. The pulp was then washed and acidified with an aqueous solution of oxalic acid to a pH of 5.5–6. Pulp characteristics are given in Table 2.

EXAMPLE 3

500 g. (b.d.) of green kenaf whole stalks (Cubano C 2032) were separated into a woody core fraction and a bark fraction following the technique described in example 1. The chemicals used in the pulping were those contained in the spent cooking liquor of the bast fibers treatment of example 1.

A semichemical pulp was prepared from the woody core fraction by cooking it at 160° C for 45 minutes under the conditions of a liquid ratio of 5, a sulfur dioxide concentration of 69 g/l and a pH of 7. The pulp characteristics are given in Table 1.

The bark fraction, after a mild refining, was treated at 80° C for 60 minutes with an aqueous solution of sodium chlorite (pH 4) (2% chlorine dioxide based on the bone dry weight of the fibers). The pulp was then washed, thickened and treated at 15% consistency with a solution containing 4.4% sodium hydroxide, 3.8% sodium carbonate (as NaOH), 1.7% hydrogen peroxide, 12.5% sodium perborate and 0.2% alkylsulfate detergent. The pulp was then washed and acidified with $SO_2$ to a pH of 5.5–6. Pulp characteristics are given in Table 2.

EXAMPLE 4

500 g. (b.d.) hemp whole stalks were separated into a woody core fraction and a bark fraction following the technique described in example 1 modified, as far as the use of chemicals, as described in example 3.

The woody core fraction was reduced to pulp by grinding in a 12 inches Sprout Waldron disc refiner. Pulp characteristics are given in Table 1. The bark fraction separated in the classification was mildly refined, thickened and treated for 90 minutes at 85° C and 15% consistency with a solution containing 4.4% sodium hydroxide, 3.8% sodium carbonate (as NaOH), 3.0% tertiary butylhydroperoxide (as hydrogen peroxide), 0.4% ethylenediaminetetracetic acid, and 0.2% alkyl sulfate detergent (based upon the weight of dry fibers). The pulp was then washed and acidified with $SO_2$ to a pH of 5.5–6. Pulp characteristics are given in Table 2.

TABLE 1

CHARACTERISTICS OF WOODY CORE PULPS

| | EX.1 | EX.2 | EX.3 | EX.4 |
|---|---|---|---|---|
| FREENESS (° SR) | 43 | 41 | 25 | 50 |
| BREAKING LENGTH, m | 1200 | 4100 | 8500 | 2300 |
| BURST FACTOR | — | 20 | 41 | 5 |
| TEAR FACTOR | 14 | 38 | 30 | 27 |
| BRIGHTNESS (Elrepho) | 70 | 81 | 65 | 61 |
| SCATTERING COEFFICIENT | 580 | 520 | 280 | 660 |

TABLE 2.

CHARACTERISTICS OF BAST FIBERS PULPS

| | EX. 1 | EX. 2 | EX. 3 | EX. 4 |
|---|---|---|---|---|
| FREENESS (° SR) | 17 | 20 | 25 | 35 |
| BREAKING LENGTH,m | 4500 | 4150 | 6700 | 3000 |

TABLE 2.-continued

CHARACTERISTICS OF BAST FIBERS PULPS

| | EX. 1 | EX. 2 | EX. 3 | EX. 4 |
|---|---|---|---|---|
| BURST FACTOR | 31 | 29 | 53 | 24 |
| TEAR FACTOR | 129 | 175 | 145 | 139 |
| BRIGHTNESS (Elrepho) | 80 | 84 | 87 | 80 |
| SCATTERING COEFFICIENT | 289 | 286 | 217 | 346 |

What I claim is:

1. A process for the preparation of pulps for paper from dicotyledonous plants, comprising the steps of:

stirring in a pulper, the dicotyledonous plants in an alkaline solution in the presence of a surfactant and at least one stain inhibiting agent selected from the group consisting of peroxides and sodium hypochlorite, which agent prevents staining of the plant fibers in alkaline media by blocking the chromophoric groups of the dicotyledonous plants, in order to obtain a stock containing both a woody core fraction and a bark fraction containing bast fibers;

dividing said stock into a woody core fraction and a bark fiber fraction; and then subsequently cooking and bleaching said bark fraction under atmospheric pressure in an alkaline solution containing an alkyl sulfate surfactant and an oxidizing agent selected from the group consisting of hydrogen peroxide and tertiary butyl hydroperoxide.

2. A process according to claim 1, wherein before cooking and bleaching, the bark fraction is treated with active chlorine generating agents.

3. A process according to claim 2, wherein the treatment with the active chlorine generating agents is performed with 2–10% active chlorine at a temperature between room temperature and 80° C for 30–120 minutes.

4. A process according to claim 1, wherein the temperature of the alkaline solution is about 75° C.

5. A process according to claim 1, wherein the alkaline solution employed in said stirring step is obtained by dissolving in water an alkaline agent selected from the group consisting of sodium hydroxide, sodium sulfite and a mixture thereof.

6. A process according to claim 1, wherein the cooking and bleaching of the bark fraction is carried out at 50°–90° C for 30–120 minutes with 2–6% peroxide calculated as $H_2O_2$, 5–20% of alkali and 0.1–0.5% of alkyl sulfate surfactant, all percentages being based on the weight of dry raw material.

7. A process according to claim 1, wherein after the cooking and bleaching step the prepared pulp is washed and acidified to a pH of 5–6 with an aqueous solution of a member selected from the group consisting of sulphur dioxide and oxalic acid.

* * * * *